US007510374B2

(12) United States Patent
Meacham

(10) Patent No.: US 7,510,374 B2
(45) Date of Patent: Mar. 31, 2009

(54) NON-CONCENTRIC RINGS FOR REDUCED TURBO-MACHINERY OPERATING CLEARANCES

(75) Inventor: Walter L. Meacham, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 649 days.

(21) Appl. No.: 11/193,915

(22) Filed: Jul. 28, 2005

(65) Prior Publication Data

US 2007/0025850 A1 Feb. 1, 2007

(51) Int. Cl.
*F01D 25/16* (2006.01)

(52) U.S. Cl. ..... 415/229

(58) Field of Classification Search ..... 415/111, 415/170.1, 230; 384/99; 29/889.2, 889.07, 29/898.09

See application file for complete search history.

(56) References Cited

U.S. PATENT DOCUMENTS 4,222,708 A 9/1980 Davison
4,330,234 A 5/1982 Colley
4,343,592 A 8/1982 May
4,421,187 A * 12/1983 Shibata et al. ..... 180/375
4,548,546 A * 10/1985 Lardellier ..... 415/133
6,309,177 B1 10/2001 Swiderski et al.
6,607,350 B2 8/2003 Dodd
2003/0190099 A1 * 10/2003 Alam et al. ..... 384/99

* cited by examiner

*Primary Examiner*—Richard Edgar
(74) *Attorney, Agent, or Firm*—Ingrassia Fisher & Lorenz, P.C.

(57) ABSTRACT

Rings having holes with a centerline offset from the centerline of the outer diameter, or other diameter piloting feature of the ring (i.e., non-concentric rings) may be used to align rotating components within their static components. Two non-concentric rings may be used to support a bearing that contains a shaft there through to allow for maximum offsets between a desired centerline of the rotating component and an actual, assembled centerline of the rotating component. Adjustment of the rotor centerline relative to the static structure centerline may be obtained without disassembly of the rotor assembly or static structure assembly.

14 Claims, 13 Drawing Sheets

NON-CONCENTRIC RINGS FOR REDUCED TURBO-MACHINERY OPERATING CLEARANCES

BACKGROUND OF THE INVENTION

The present invention generally relates to methods and apparatus for centering rotating components within their stators and, more specifically, to methods and apparatus using non-concentric rings for reduced turbo-machinery operating clearances.

Performance of turbo machinery depends upon operating clearances of rotating components, such as aerodynamic components, in relation to their stators. For aerodynamic components, tighter clearances between the rotating component and its associated stators results in higher efficiency resulting in less fuel burn and more power. Operational clearances are affected by the ability to radially center rotating components within their associated stators. Rotating components may consist of aerodynamic components, such as impellers, compressors, turbines, and seals, or may consist of electric machines and bearing journals. Tighter geometric control of parts at increased cost is often required to reduce the variation in build clearances due to part runout control.

Referring to FIG. 1, there is shown a conventional turbo machine 10. A forward (cold) end 12 may house a first bearing compartment 14 and an aft (hot) end 16 may house a second bearing compartment 18. While not limited to such, the turbomachine 10 of FIG. 1 has two turbine rotors 20 and a shaft 22. The turbines 20 are contained within the turbine static structure 24 forming a clearance 36.

Several parameters may affect the operating clearances 36 of the turbine rotors 20 relative to the static structure 24. These include the dimensional tolerance of the component, e.g., turbine rotor, the operational range of the turbomachine (e.g., speed, temperature, altitude and power), and the ability to center the rotating component(s) (such as turbine rotors 20) within its static structure 24, such as a turbine shroud.

Component tolerances in areas where the clearances need to be controlled between rotating and static components are often held very tight. Conventionally, these rotating and static components may be match-machined to minimize the effect of this variable. Advanced analytical tools and design processes have resulted in the ability to control the clearance between parts during the various operating conditions for which the machine is to be used.

Control of the concentricity of the rotating component to the static component may depend upon the geometric controls of the components that are within the path (stack) of the rotating component and the static component. Rotating components require tight geometric tolerances in order to operate without excessive vibration. However, the static components, being larger and more complex, are often not able to have tight geometric controls, potentially resulting in an offset between the rotating and static components.

The basic effect of this radial offset is shown schematically in FIG. 2, where a shaft centerline 26 of shaft 22 may lack concentricity with a turbine shroud centerline 28 of turbine shroud 24. This may result in a circumferential variation in clearance, which can be referred to as a non-uniform clearance, between the rotating components (in this case, the turbine 20) and the static component (in this case, a turbine shroud 24). This variation in clearance may result in a small turbine clearance 30 and a large turbine clearance 32 within turbine shroud 24. A radial cross-sectional view of this offset is shown in FIG. 3.

The current state of the art offers three basic approaches to concentricity between rotating components and static components. The first approach suggests operating with larger than desired clearances, thereby accepting lower machine performance. The second approach suggests improving the geometric control of the static components, however at a significant increase in component cost. The third approach involves match-set machining the static component to the rotor component, again at an increased cost and the creation of match, non-interchangable, sets.

U.S. Pat. No. 6,309,177, issued to Swiderski et al., uses a single non-concentric ring to center a turbine stator (static component) relative to the turbine rotor (rotating component). A single ring has limited ability to correct for non-concentricities between a rotating and non-rotating component. The '177 patent uses rings with different degrees of non-concentricities to improve its ability to adjust the turbine stator relative to the turbine rotor. This is accomplished by measuring the eccentricity (runout) between the turbine stator and turbine rotor and selecting the appropriate non-concentric ring. This also resulted in match set hardware and if a component is replaced, a different ring might be required to maintain a uniform clearance.

U.S. Pat. No. 4,222,708, issued to Davison, uses a pair of frame components with annuluses which have outer and inner surfaces that are relatively eccentric to each other. Each frame component has two radial pilot features that are non-centric to one another. The '708 patent addresses the position of the shroud centerline relative to the rotor centerline to make a single rotating component concentric within the frame. The '708 patent, as does the '177 patent relates to adjustment of a portion of the static structure centerline relative to the rotor center centerline to minimize clearances.

As can be seen, there is a need for improved methods and apparatus for reducing turbo machinery operating clearances. There is also a need for methods and apparatus to adjust the rotor relative to the static structure, thereby centering a plurality of components on a single rotor/shaft.

SUMMARY OF THE INVENTION

In one aspect of the present invention, a turbomachine comprises a rotor; a turbine coupled to the rotor; a turbine shroud housing the turbine; at least a first bearing on a first axial location of the rotor; a second bearing on a second axial location of the rotor; and a first non-concentric ring supporting the first bearing.

In another aspect of the present invention, a turbomachine comprises a rotor; a turbine coupled to the rotor; a turbine shroud housing the turbine; at least a first bearing on a first axial location of the rotor; a second bearing on a second axial location of the rotor; a first non-concentric ring supporting the first bearing; and a second non-concentric ring supporting the second bearing.

In yet another aspect of the present invention, a method of matching a centerline of a rotating component within a centerline of a static component, the method comprises supporting the rotating component by a first bearing; supporting the first bearing with a first non-concentric ring, the first non-concentric ring having a hole with a hole centerline offset from a ring centerline of the outer diameter of the first non-concentric ring; and rotating the first non-concentric ring to align the centerline of the rotating component with the centerline of the static component.

Machinery comprising a rotor and a rotor housing may have at least a first bearing at a first axial location on the rotor and a first non-concentric ring supporting the first bearing.

The rotor may be supported by a second bearing at a second axial location on the rotor and a second non-concentric ring supporting the second bearing. In addition, each bearing may be supported by subsequent non-concentric rings to increase the fidelity of rotor to static structure alignment. A concentric ring may exist between the first and subsequent non-concentric ring. A concentric ring may exist between the second and subsequent non-concentric ring.

By adjustment of non-concentric rings supporting one or more bearings, the centerline of a rotating group can be adjusted relative to the static structure, providing more uniform operating clearances. Depending upon the needs of the turbomachinery, a single non-concentric ring can be located on a first bearing to adjust to rotor drop due to gravity. Two sets of non-concentric rings can be located on each bearing to optimize clearances between all rotor components and the static structure. Whereas adjustment of a single static component results in the optimization of clearance between the adjusted static component and the associated rotating component, the adjustment of the rotor centerline relative to the static structure results in an adjustment of all of the rotating components relative to the static structure. With the appropriate selection of non-concentric rings supporting each bearing, the optimum clearance of all of the rotating components relative to the static structure may be achieved.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides apparatus and methods for reducing operating clearances of rotating components within their stators. The rotating components may be aerodynamic components on a rotor, such as compressors and turbines, or a rotating seal, or other rotor assemblies, such as a generator rotor. The present invention may use non-concentric rings to center rotating components within a static housing. Unlike the prior art methods, which may use a single non-concentric component, or which may use eccentric frame members to center a single stator to a rotor, the present invention provides at least one non-concentric ring that may center multiple rotor or aerodynamic components within their associated stators, often without the need for additional hardware. It will also be shown that by supporting the rotor with at least one non-concentric ring that multiple rotor or aerodynamic components may be centered within their associated static component or stators while in the assembled condition, thus eliminating the need to disassembly the rotor or static assemblies to make adjustments.

Figure 4B:
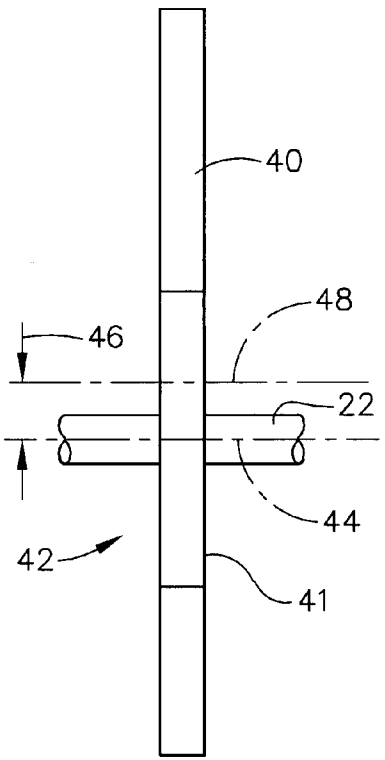
FIG. 4*b* shows an axial view of the non-concentric ring of FIG. 4*a;*
Figure 4A:
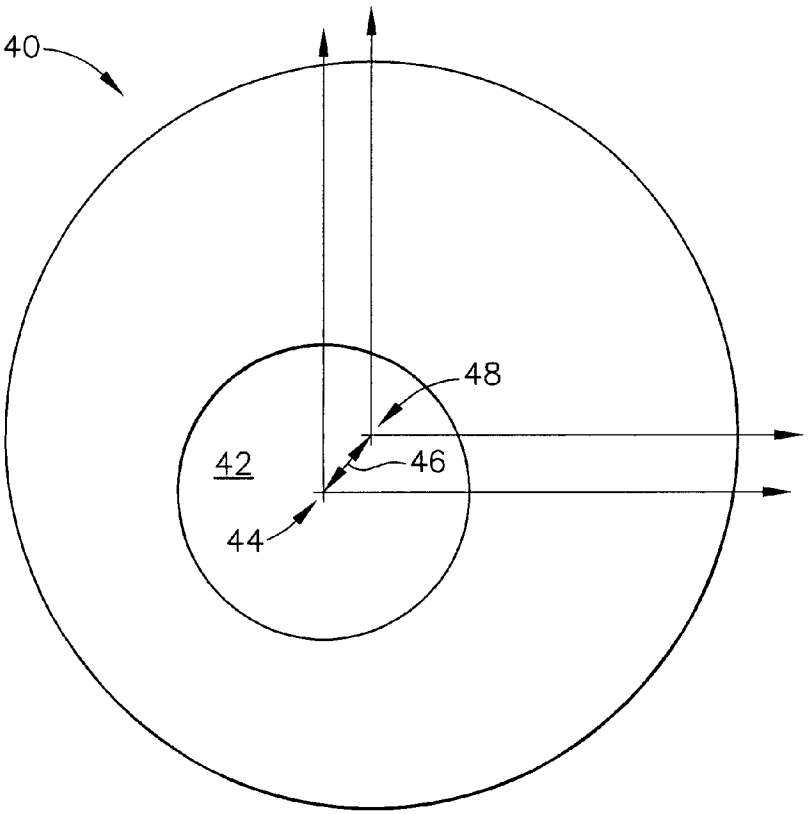
FIG. 4*a* is a radial cross-sectional view showing a non-concentric ring according to the present invention.

Referring to FIG. 4*a*, there is shown an example of a non-concentric ring 40 according to the present invention. The non-concentric ring 40 may have a hole 42 that is non-concentric to the outer diameter of the non-concentric ring 40. Hole 42 may be an inner-diameter locating feature and the outer-diameter of the non-concentric ring 40 may be an outer-diameter locating feature. A bearing 41 (see, for example, FIG. 4*b*) may fit in hole 42 to support the shaft 22 therein. In other words, a hole centerline 44 may have an offset 46 from a ring centerline 48 of the outer diameter of the non-concentric ring 40. Offset 46 may be from about 0.0001" to about 1". In one embodiment of the invention, offset 46 may be about 0.002".

Referring to FIG. 4*b*, there is shown an axial view of the non-concentric ring 40 of FIG. 4*a*. Non-concentric ring 40 may have its ring centerline 48 offset (designated by 46) from hole centerline 44. A bearing 41 may be present in the hole 42 to support the shaft 22. In general, a non-concentric ring may consist of any non-rotating component supporting the rotor, including a bearing outer-race, a squirrel cage used to support the bearing, a bearing housing or ring design specifically for this function and surrounds the outer-race of the bearing.

Figure 4C:
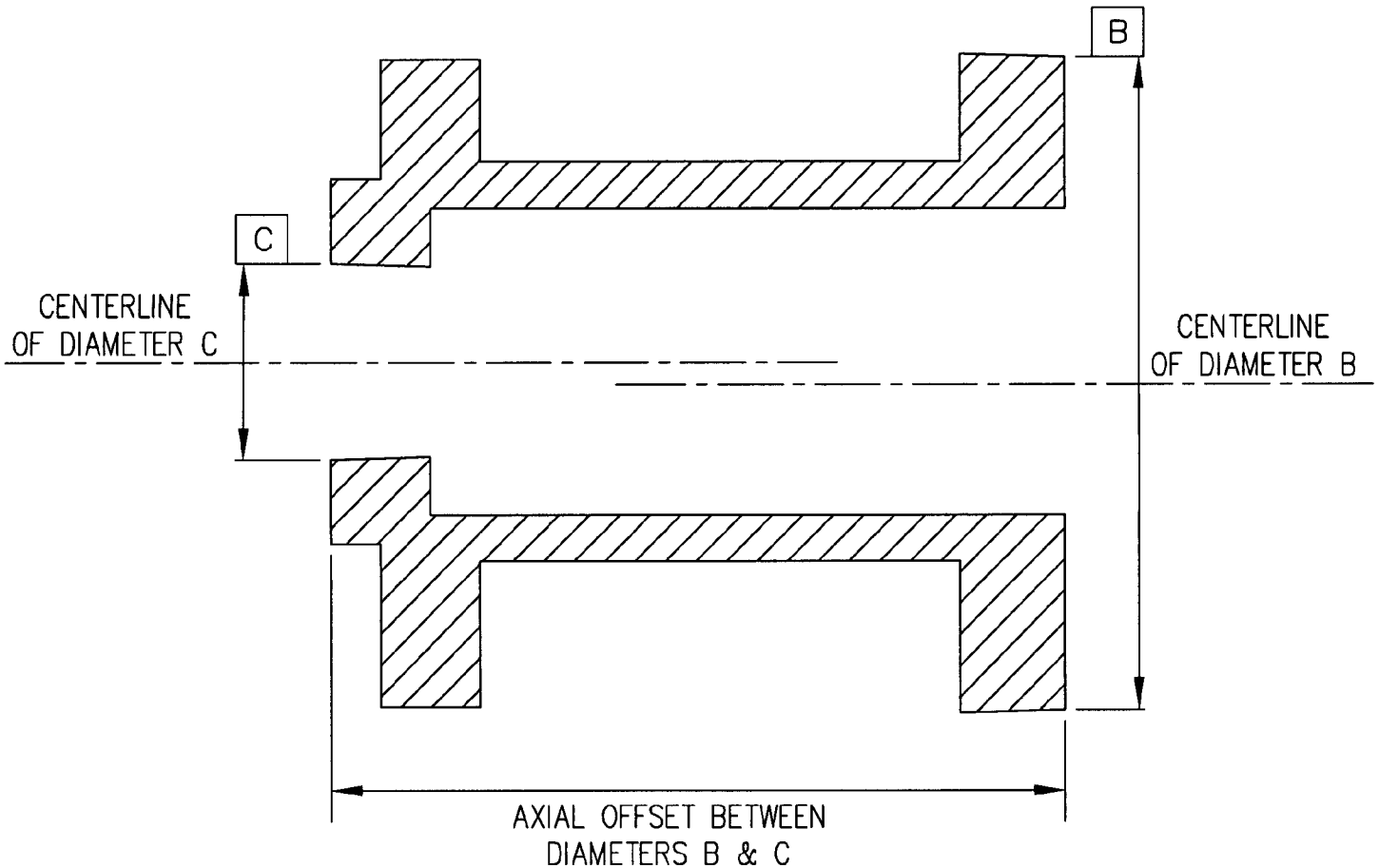
FIG. 4*c* shows an axial view of the non-concentric ring of FIG. 4*a* where the radial pilots are offset axially.

Referring to FIG. 4C, there is shown an axial view of the non-concentric ring 40 of FIG. 4*a* which may have its radial pilots offset axially. Non-concentric ring 40 may have its ring centerline 48 offset radially (designated by 46) from hole centerline 44 and the locating feature 42 (hole 42) may be axially offset from the outer diameter of the non-concentric ring 40. In a general since, feature 42 may be an inner-or outer-diameter locating feature and the outer diameter of the non-concentric ring 40 may be an inner-or outer-diameter locating feature.

Figure 5:
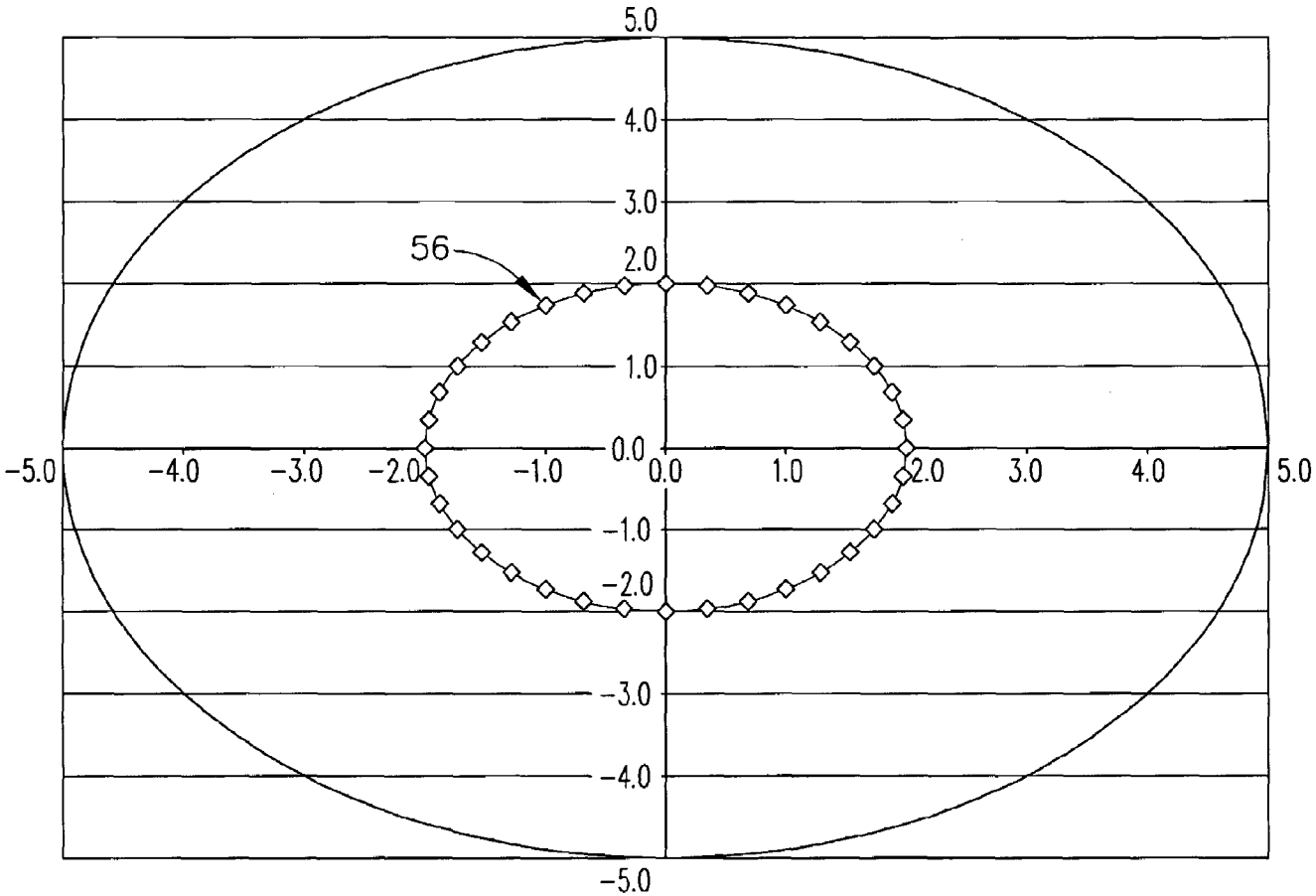
FIG. 5 is a graph depicting potential locations of the center of a hole in a non-concentric ring according to an embodiment of the present invention.

Referring to FIG. 5, there are shown exemplary locations of the centerline 44 of the hole 42 in relation to the centerline 48 of the outer diameter of the non-concentric ring 40 of FIG. 4*a*. As the non-concentric ring 40 is rotated about its centerline 48, the centerline 44 of the hole 42 may move along the locations 56 shown in FIG. 5 due to the non-concentricity of the non-concentric ring 40. The centerline 44 of the hole 42 may correlate to the shaft 22. As can be seen, the variation of the location of a rotating part (such as the shaft 22 and the turbines 20) relative to the static part (such as the turbine shroud 24) may be based on the amount of non-concentricity and the orientation of the hole 42. For illustrative purposes, a hole of a non-concentric ring will be used to describe two radially locating features where they may be outer-diameter features and inner-diameter features or a combination of the two.

Figure 1:
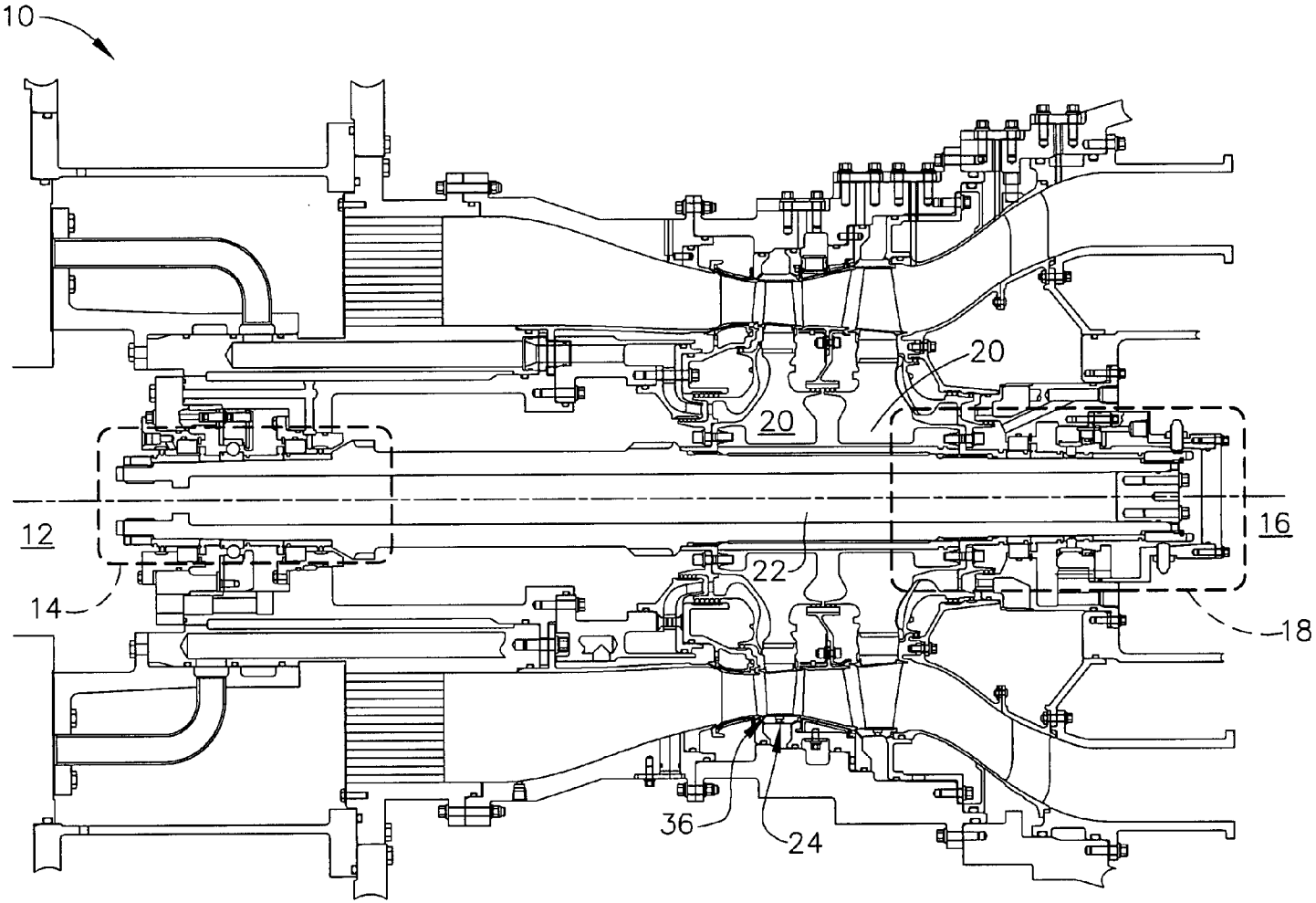
FIG. 1 is an axial cross-sectional view of a conventional turbo machine adaptable to use the non-concentric rings of the present invention.
Figure 2:
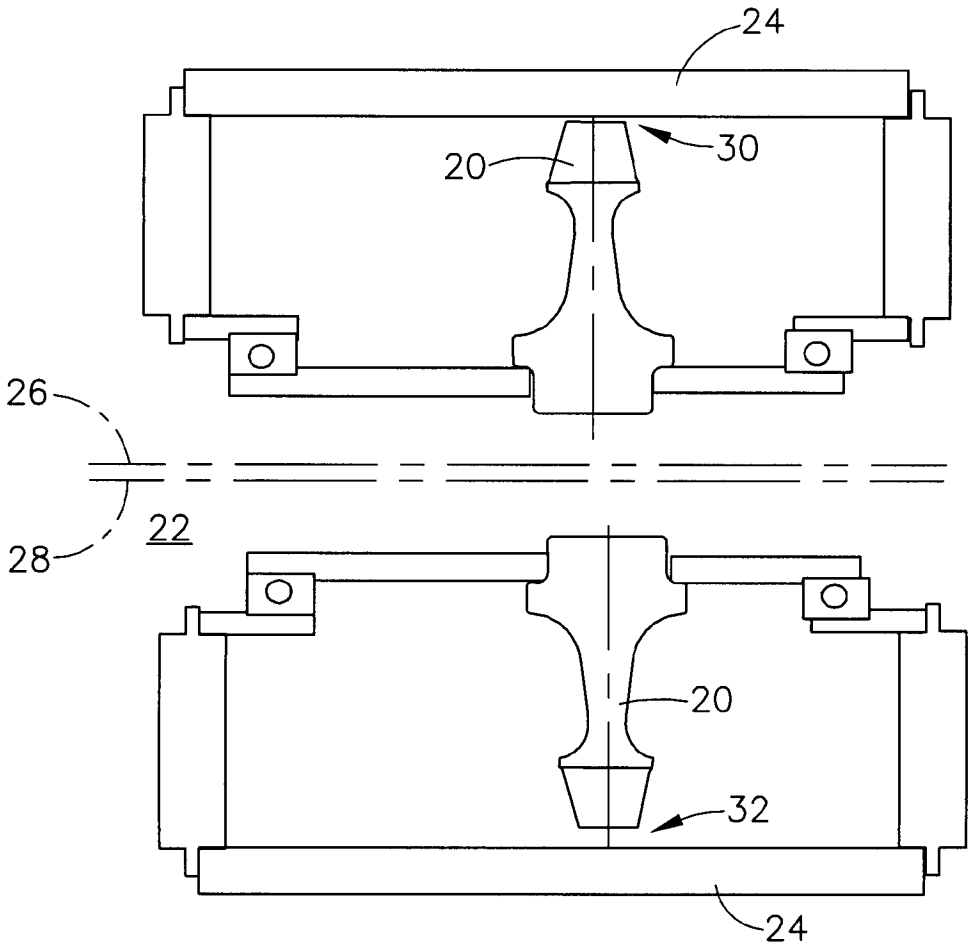
FIG. 2 is a schematic axial cross-sectional view of a conventional turbo machine showing component clearance due to lack of concentricity.
Figure 3:
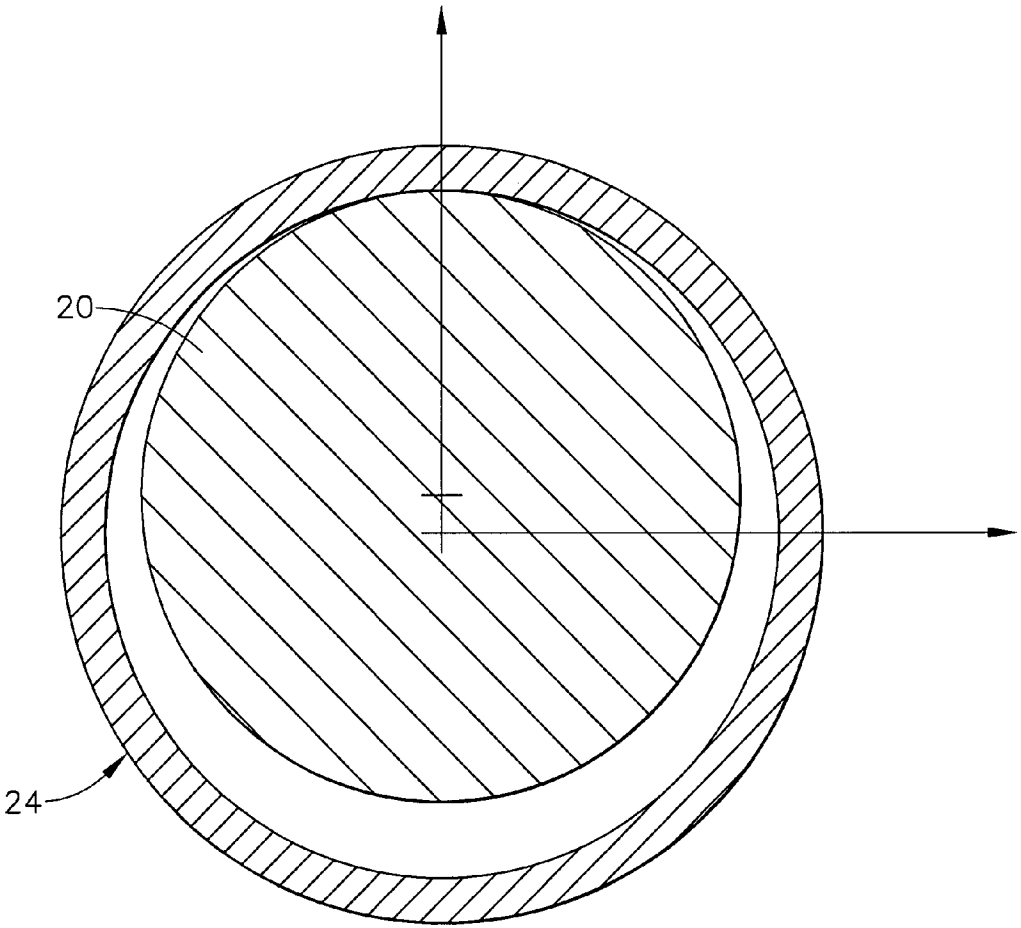
FIG. 3 is a radial cross-sectional view showing the lack of concentricity in the conventional turbo machine of FIG. 2.

A single non-concentric ring 40, with a predetermined amount of non-concentricity, may be used to support bearing 41 to compensate for measured non-concentricity of a rotating component within a static component (such as is shown in FIGS. 2 and 3). However, according to one embodiment of the present invention, two non-concentric rings 40, that each have holes 42 set in similar or different non-concentric positions, may be independently rotated to center the shaft (rotor) 22 within the static component. This two-ring configuration may be particularly useful to center or align the shaft 22 within the static component for any potential lack of concentricity that might arise due to multiple pilots (such as multiple turbines 20) in a typical static structure (e.g., a bank of stators in a turbine section).

Figure 6A:
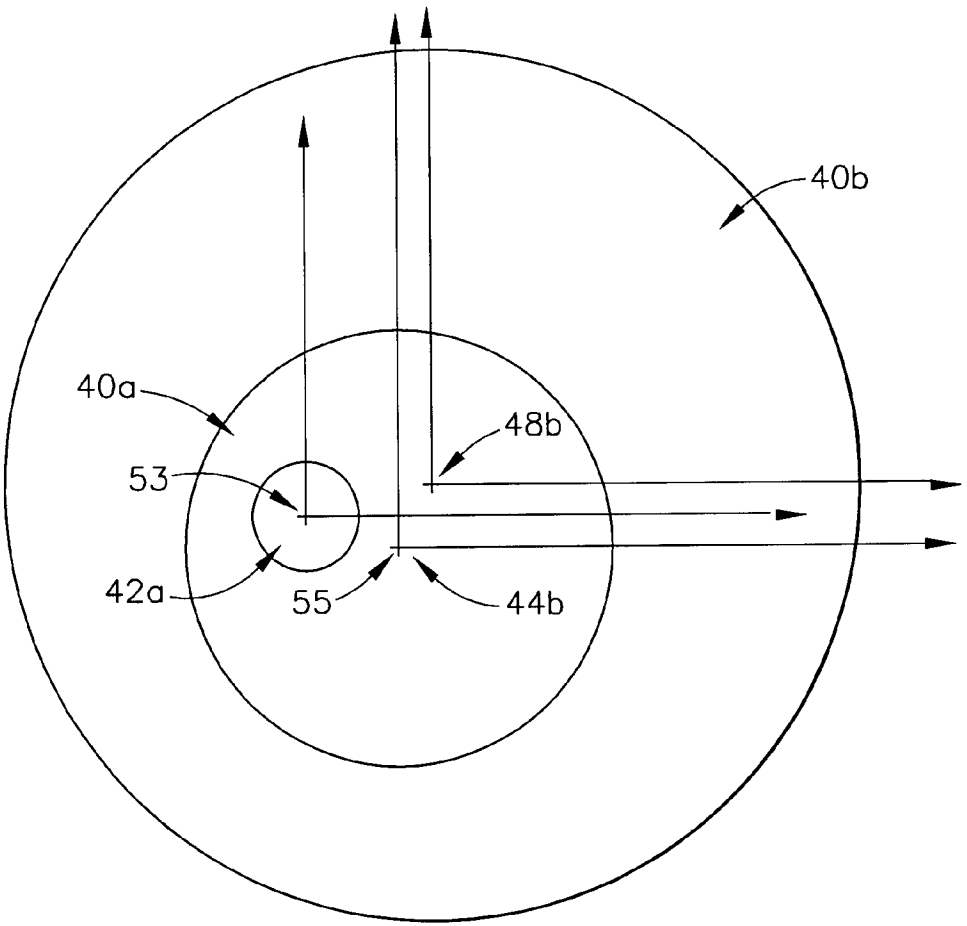
FIG. 6*a* is an example of a pair of non-concentric rings that may be used to support a bearing according to an embodiment of the present invention.
Figure 6B:
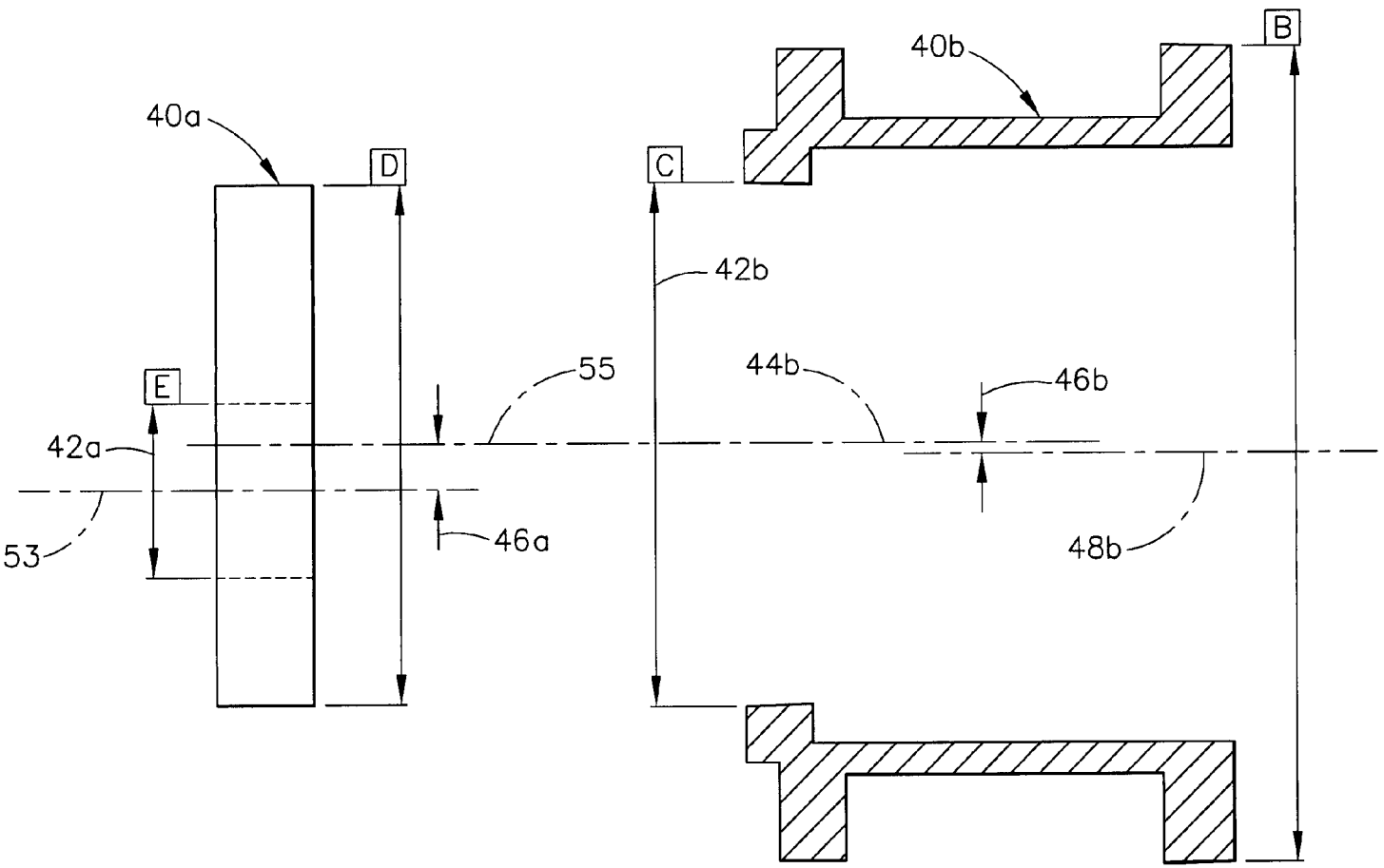
FIG. 6*b* is a cross-sectional view showing the use of two non-concentric rings, according to an embodiment of the present invention.

Referring now to FIG. 6*a*, there is shown an example of a pair of non-concentric rings 40*a* and 40*b* that may be used to support a bearing (see FIG. 4*b*). A side view of FIG. 6*a* is provided in FIG. 6*b*. The arrangement of FIG. 6*a* may have the capability to compensate for the potential lack of concentricity between rotating components (such as turbine rotor 20) and its static components (such as turbine shroud 24). Non-concentric ring 40*b* may have a first locating diameter -B- that defines centerline 48*b* relative to the first locating diameter -B- and a second locating diameter -C-, which defines centerline 44*b*. Centerlines 44*b* and 48*b* may be offset by a pre-determined amount 46*b*. As ring 40*b* is rotated, centerline 44*b* may move relative to 48*b*, as shown in FIG. 5. Diameter -C- may define a hole 42*b*, in which a second non-concentric ring 40*a* may be mounted. Non-concentric ring 40*a* centerline 55 may be the same as non-concentric ring 40*b* centerline 44*b*. Non-concentric ring 40*a* may also have a hole 42*a* with a centerline 53. The centerline 53 of the hole 42*a* of the non-concentric ring 40*a* may be offset from non-concentric ring 40*a* centerline 55 by a predetermined amount 46*a*. Non-concentric ring 40*a* can be rotated relative to 40*b* to adjust centerline 53 as required to adjust shaft 22 (not shown) and associated rotor components (such as turbine 20) relative to the static structure (such as turbine stator 24). It should be noted that non-concentric ring 40*a* may be the outer-race of a bearing, or non-concentric ring 40*a* hole 42*a* may accommodate a bearing for support of rotor 22.

Figure 7:
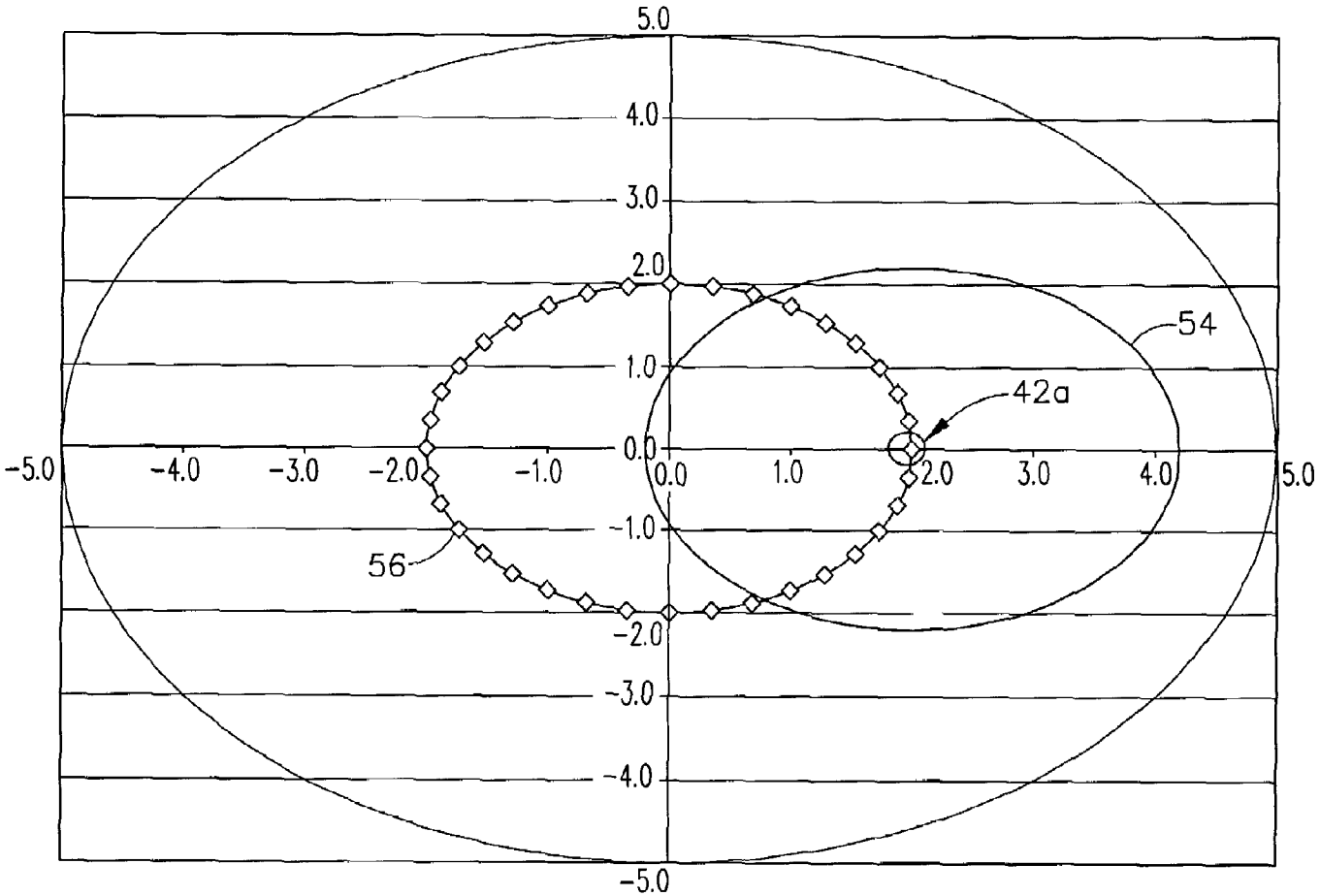
FIG. 7 is a graph depicting potential locations of the center of a hole in a non-concentric ring, according to the present invention.

Referring to FIG. 7, there is shown an example of using the two non-concentric rings 40*a*, 40*b* of FIG. 6 to find potential positions of the shaft 22 when the second non-concentric ring 40*b* is fixed and the first non-concentric ring 40*a* is rotated. A solid line 54 in FIG. 7 encompasses potential positions of the centerline 53, which coincides with centerline 26 of shaft 22, of the first non-concentric ring 40*a* when the first non-concentric ring 40*a* is rotated while the second non-concentric ring 40*b* is fixed (not rotated). A diamond-marked line 56 encompasses potential positions of the centerline 44*b* of the second non-concentric ring 40*b*, if there were only one non-concentric ring 40 present (see FIG. 5).

Figure 8:
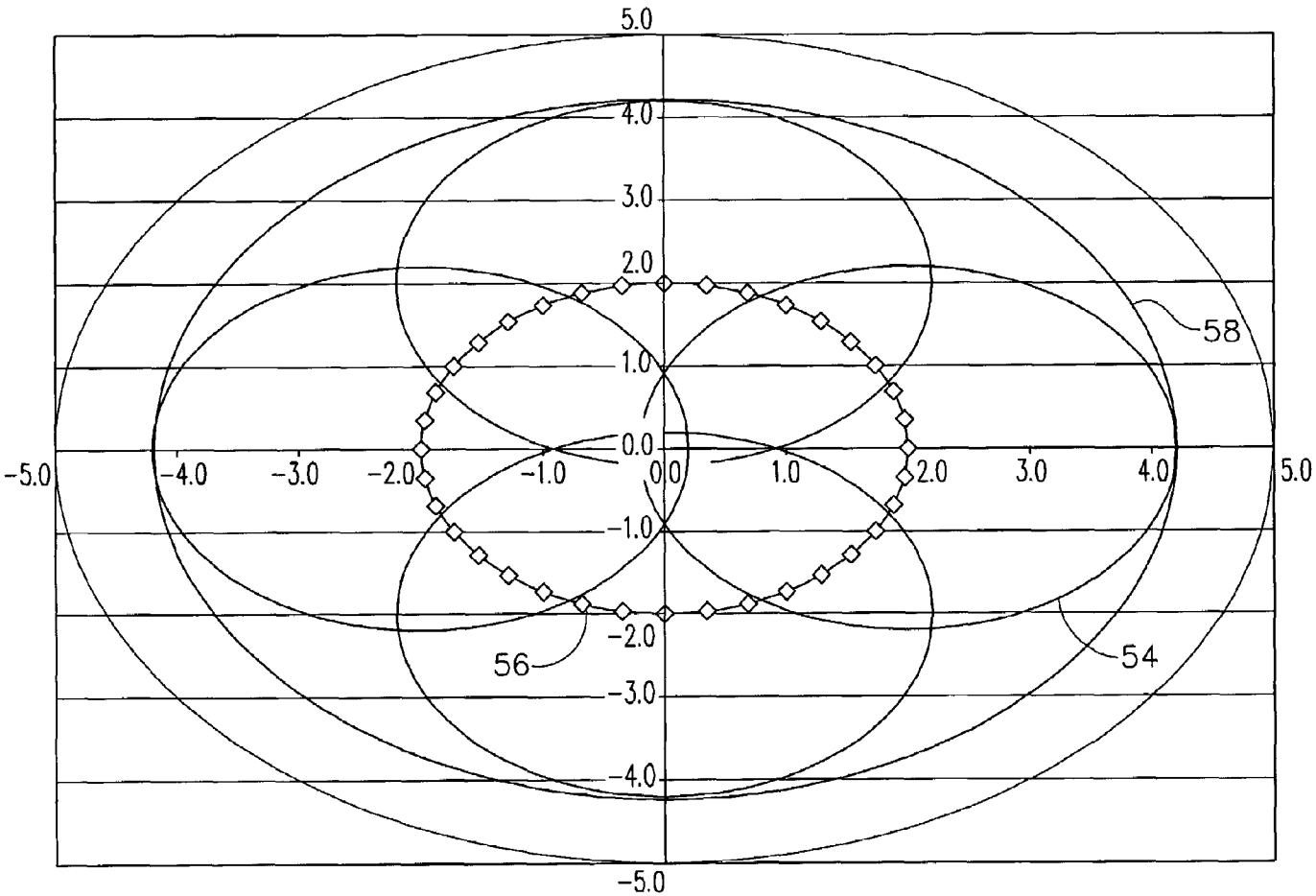
FIG. 8 is a graph depicting potential locations of the center of a hole in a non-concentric ring, according to another embodiment of the present invention.

Referring now to FIG. 8, there is shown a further example of using the two non-concentric rings 40*a*, 40*b* of FIG. 6. In this example, if both the first and second non-concentric rings 40*a*, 40*b* are rotated independently with respect to each other, one may adjust the center of the rotor (centerlines 53, 26) over a large range due to the non-concentricity of the holes 42 of the non-concentric rings 40*a*, 40*b*. A solid line 58 shows the potential positions of the centerline 26 of the shaft 22 by using two non-concentric rings 40*a*, 40*b*. In essence, two non-concentric rings 40*a*, 40*b* may be designed so that they can adjust a large range of potential outcomes of the available hardware. Therefore, no additional hardware may be needed to center multiple rotating components within static components.

Figure 9:
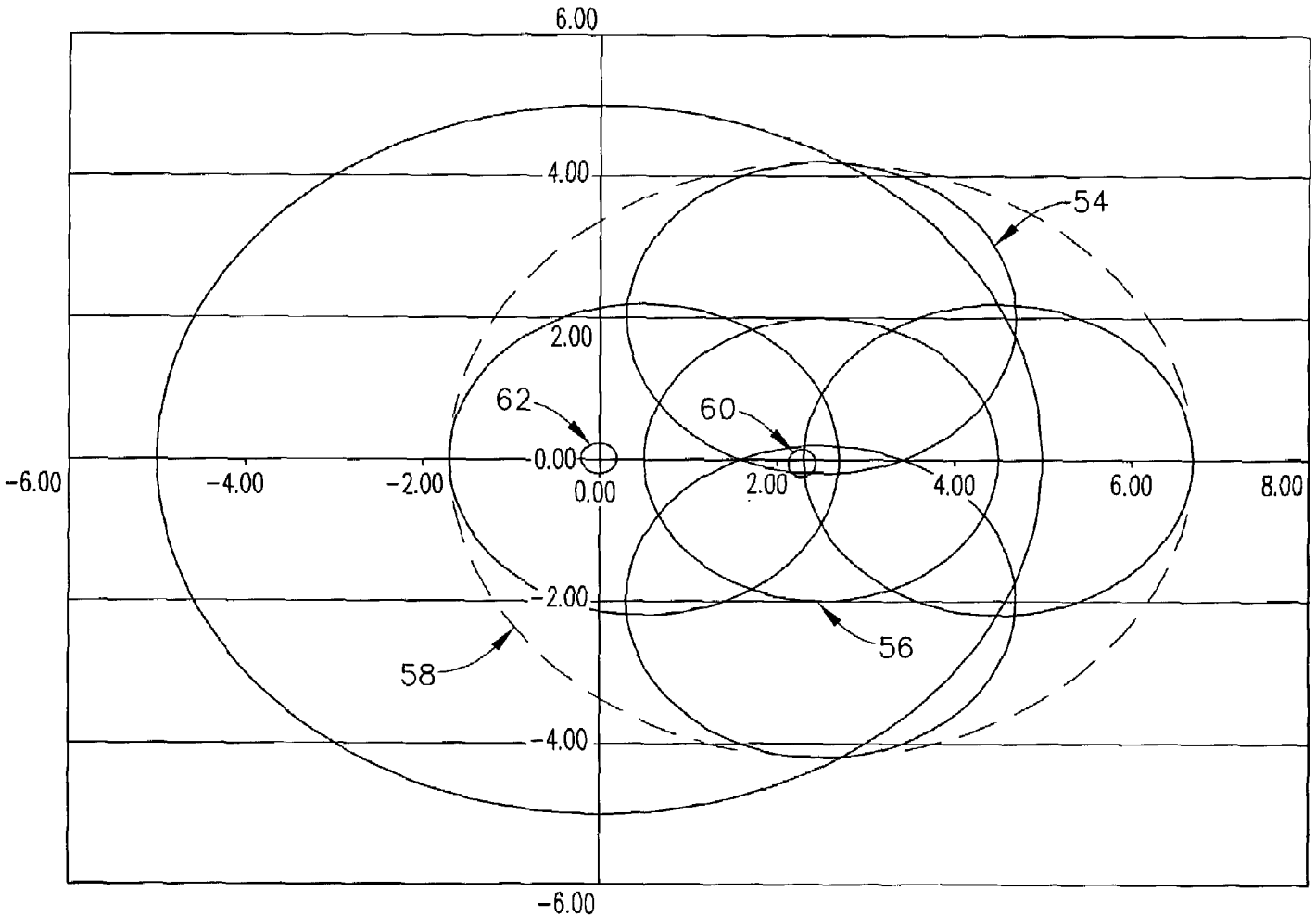
FIG. 9 is a graph depicting an example of the capability of two non-concentric rings to center a turbine within a turbine shroud.

FIG. 9 shows one example according to the principles of the present invention. For example, if the centerline 26 of the shaft 22 is 2.5 mils offset from a centerline 28 of the turbine shroud 24 at assembly, the turbine 20 would have a non-uniform operating clearance if, for example, the desired operational clearance was 5.0 mils. On one side, the turbine 20 would have a 2.5 mil operating clearance, while on the other side, the turbine 20 would have a 7.5 mil clearance (see, for example, turbine clearances 30, 32 of FIG. 2).

With two non-concentric rings 40*a*, 40*b*, it may be possible to adjust the centerline 26 of the shaft 22 so that it coincides with the centerline 28 of the turbine shroud 24. A centerline at assembly 60 of shaft 22 may be offset from a desired centerline 62 (corresponding to centerline 28 of turbine shroud 24). In FIG. 9, line 54 depicts the range of adjustment of shaft centerline 26 by using two non-concentric rings 40*a*, 40*b*, one of which is fixed and one of which is rotated (see FIG. 7). Line 56 depicts the range of adjustment of shaft centerline 26 by using one non-concentric ring 40 (see FIG. 5). Dashed line 58 depicts the range of adjustment of shaft centerline 26 that may be available by rotating both the first and second non-concentric rings 40*a*, 40*b*. As line 58 shows, when both the first and second non-concentric rings 40*a*, 40*b* are adjusted, it may be possible to adjust the centerline 26 of shaft 22 to correspond to the desired centerline 62.

The present invention may be used to support a single bearing by using one or two non-concentric rings 40 or 40*a*, 40*b*. This single bearing may be located, for example, in the first bearing compartment 14. Furthermore, the present invention may be used to support a second bearing by using one or two non-concentric rings 40 or 40*a*, 40*b*. This second bearing may be located, for example, in the second bearing compartment 18. For both bearing supports, their may exist one or more concentric rings between the first and second non-concentric rings supporting the bearing.

Figure 10:
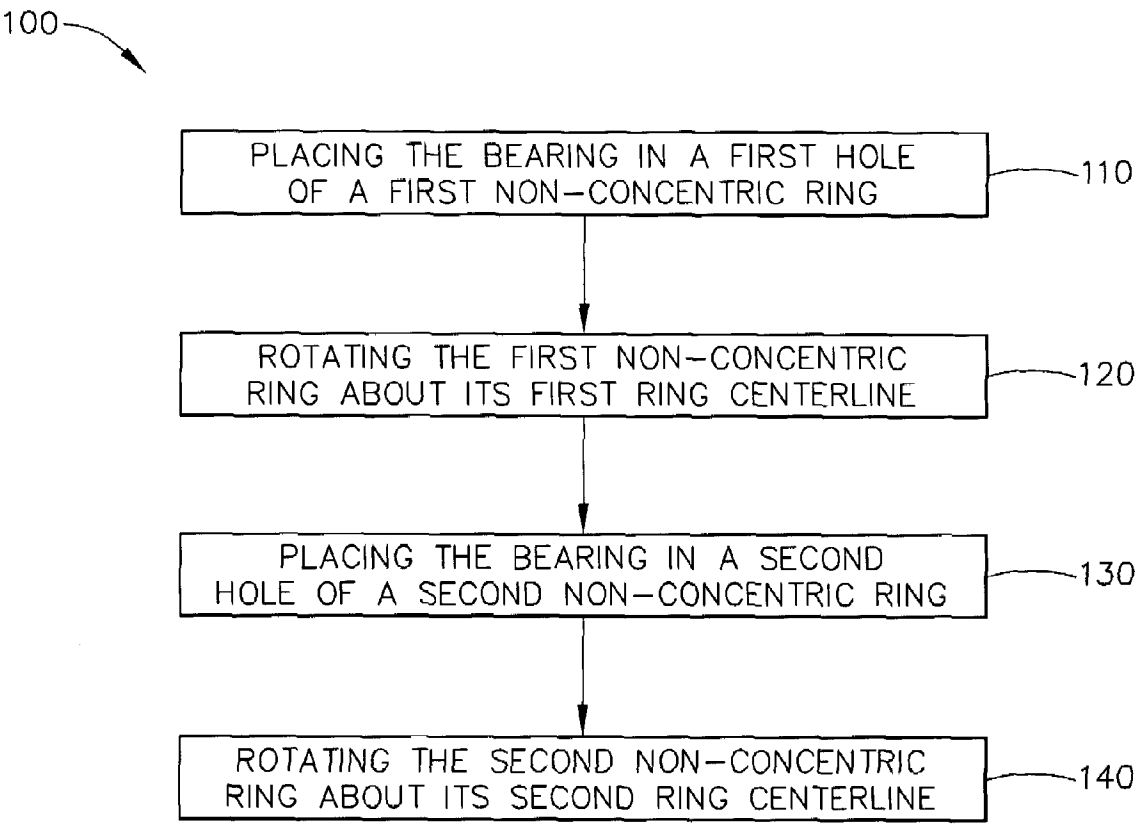
FIG. 10 is a flow chart showing a method according to one embodiment of the present invention.

Referring to FIG. 10, there is shown a flow chart showing a method 100 of the present invention. Without limiting the scope of the invention, the method 100 may describe one embodiment of the present invention. A method for supporting a bearing may include a step 110 of placing the bearing in a first hole of a first non-concentric ring and a step 120 of rotating the first non-concentric ring about its first ring centerline. The first non-concentric ring may have a first hole with its first hole centerline offset from the ring centerline of the first non-concentric ring. Optional step 130 may involve placing the bearing in a second hole of a second non-concentric ring. Optional step 140 may involve rotating the second non-concentric ring about its second ring centerline. The second non-concentric ring may have a second hole with its second hole centerline offset from the second ring centerline of the second non-concentric ring. The first non-concentric ring may be in a first bearing compartment on a first end of a shaft or rotor. The second non-concentric ring may also be in the first bearing compartment.

Figure 11:
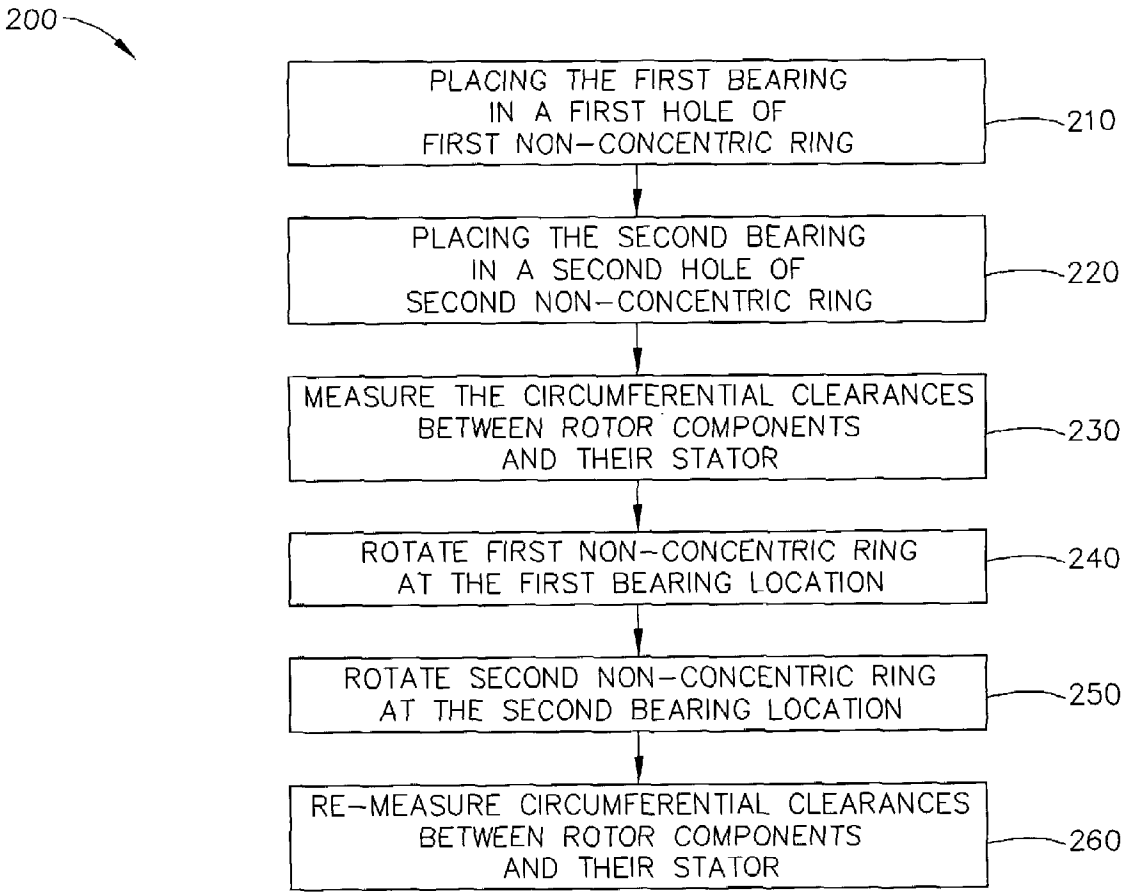
FIG. 11 is a flow chart showing a second method according to another embodiment of the present invention.

Referring to FIG. 11, there is shown a flow chart of method 200 of the present invention. In step 210, the first bearing may be placed in a first hole of the first non-concentric ring. In step 220, the second bearing may be placed in a second hole of the second non-concentric ring. In step 230, the circumferential clearances between the rotor components and their stator may be measured. The first non-concentric ring at the first bearing location may be rotated in step 240. The second non-centric ring at the second bearing location may be rotated in step 250. In step 260, the circumferential clearances between rotor components and their stator may be re-measured. Steps 240 through 260 may be repeated until the circumferential clearances between the rotor components and their stator are within a predetermined limit. The process described in FIG. 10 may be applied to FIG. 11 where there are more than one non-concentric ring at either or both the first bearing and the second bearing.

It should be understood, of course, that the foregoing relates to exemplary embodiments of the invention and that modifications may be made without departing from the spirit and scope of the invention as set forth in the following claims.

I claim:

1. A turbomachine comprising:

a rotor having a first end and a second end;

a turbine coupled to the rotor;

a turbine shroud housing the turbine;

a first bearing coupled to the rotor at a first axial location near the first end of the rotor;

a second bearing coupled to the rotor at a second axial location near the second end of the rotor;

a first non-concentric ring supporting the first bearing;

a second non-concentric ring supporting the first non-concentric ring;

a third non-concentric ring supporting the second bearing; and a fourth non-concentric ring supporting the third non-concentric ring.

2. The turbomachine of claim 1, further comprising:

a first bearing compartment supporting the first bearing; and a second bearing compartment supporting the second bearing, wherein the first bearing compartment is at the first axial location along the rotor and the second bearing compartment is at the second axial location along the rotor.

3. The turbomachine of claim 1, where the rotor is comprised of a plurality of rotating components with a plurality of static components housing the rotating components.

4. The turbomachine of claim 1, having more than two bearings located axially along the rotor.

5. The turbomachine of claim 4 where more than two bearings are each supported by at least two non-concentric rings.

6. The turbomachine of claim 1, further comprising:

a third bearing coupled to the rotor at a third location along the rotor; and a fifth non-concentric ring supporting the third bearing.

7. The turbomachine of claim 6, further comprising a sixth non-concentric ring supporting the fifth non-concentric ring.

8. A method of matching a centerline of a rotating component having a first end and a second end within a centerline of a static component, the method comprising:

supporting the first end of the rotating component by a first bearing;

supporting the first bearing with a first non-concentric ring, the first non-concentric ring having a hole with a hole centerline offset from a ring centerline of the outer diameter of the first non-concentric ring;

supporting the first non-concentric ring with a second non-concentric ring;

rotating the first and second non-concentric rings to align the centerline of the first end of the rotating component with the centerline of the static component;

supporting the second end of the rotating component by a second bearing;

supporting the second bearing with a third non-concentric ring, the third non-concentric ring having a hole with a hole centerline offset from a ring centerline of the outer diameter of the third non-concentric ring; and rotating the third and fourth non-concentric rings to align the centerline of the second end of the rotating component with the centerline of the static component.

9. The method according to claim 8, wherein the offset is from about 0.0001" to about 1".

10. The method according to claim 8, wherein there are a plurality of rotating components mounted on the rotor with a plurality of static components housing the rotating components.

11. The method according to claim 8, wherein there are more than two bearings located axially along the rotor and one or more of the bearings are supported by at least two non-concentric rings each.

12. The method of claim 8 further comprising:

supporting the rotating component at a third location by a third bearing;

supporting the third bearing by a fifth non-concentric ring; and supporting the fifth non-concentric ring with a sixth non-concentric ring.

13. The method of claim 8, further comprising determining the acceptability of the circumferential clearance by measuring a circumferential clearance and comparing the circumferential clearance to a predetermined value.

14. The method of claim 13, further comprising rotating at least one of the first, second, third, and fourth non-concentric rings in response to determining an unacceptable circumferential clearance.

* * * * *